US009941091B2

(12) United States Patent
Jeong et al.

(10) Patent No.: US 9,941,091 B2
(45) Date of Patent: Apr. 10, 2018

(54) X-RAY TUBE

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 251 days.

(21) Appl. No.: 15/074,859

(22) Filed: Mar. 18, 2016

(65) Prior Publication Data

US 2016/0307725 A1 Oct. 20, 2016

(30) Foreign Application Priority Data

Apr. 17, 2015 (KR) ..... 10-2015-0054595
Feb. 2, 2016 (KR) ..... 10-2016-0012962

(51) Int. Cl.
*H01J 35/00* (2006.01)
*H01J 35/06* (2006.01)
*H01J 35/08* (2006.01)

(52) U.S. Cl.
CPC ..... *H01J 35/065* (2013.01); *H01J 35/08* (2013.01)

(58) Field of Classification Search
CPC .. H01J 35/00; H01J 35/02; H01J 35/04; H01J 35/06; H01J 35/065; H01J 35/08; H01J 35/14; H01J 35/16; H01J 2235/00; H01J 2235/06; H01J 2235/08; H01J 2235/165; H01J 2235/166; H01J 2235/168
USPC ..... 378/121, 122
See application file for complete search history.

(56) References Cited

U.S. PATENT DOCUMENTS 3,452,232 A * 6/1969 Muraki ..... H01J 35/06 378/134
2012/0250827 A1 10/2012 Jeong et al.
2013/0022173 A1 1/2013 Jeong et al.
2013/0028386 A1 1/2013 Jeong et al.

FOREIGN PATENT DOCUMENTS

| | | | |
|---|---|---|---|
| JP | H02-260354 | A | 10/1990 |
| JP | H03-53739 | U | 5/1991 |
| JP | 2000-030642 | A | 1/2000 |
| JP | 2009-087633 | A | 4/2009 |
| JP | 2010-186694 | A | 8/2010 |
| KR | 10-2009-0039981 | A | 4/2009 |
| KR | 10-2013-0084257 | A | 7/2013 |
| WO | WO 2013/131628 | A1 | 9/2013 |

* cited by examiner

*Primary Examiner* — Jurie Yun

(57) ABSTRACT

An X-ray tube includes a cathode including an emitter emitting an electron beam, an anode at which a target material is disposed, the target material emitting an X-ray by colliding with the electron beam, and an insulating spacer isolating the anode, wherein the cathode or the anode is disposed between the emitter and the insulating spacer.

6 Claims, 2 Drawing Sheets

X-RAY TUBE

CROSS-REFERENCE TO RELATED APPLICATION

The present application claims priority to Korean Patent Application Numbers 10-2015-0054595 filed on Apr. 17, 2015 and 10-2016-0012962 filed on Feb. 2, 2016, in the Korean Intellectual Property Office, the entire disclosure of which is incorporated by reference herein.

BACKGROUND

1. Field

An aspect of the present disclosure relates to a structure of an X-ray tube.

2. Description of the Related Art

FIG. 1 illustrates a general structure of an X-ray tube requiring a high acceleration voltage may be configured to include a cathode 10 for emitting an electron beam, an emitter 11, a gate 20, a focusing electrode 30, and an anode 40. The electrodes may be electrically isolated from each other by an insulating spacer 50. The insulating spacer 50 may have a tubular shape. When the emitter 11 is a thermoelectron source, the gate 20, the focusing electrode 30, and the like may be omitted. When the emitter 11 is a field emission electron, the focusing electrode 30 may be integrated with the gate 20 to have the same potential. Electrons ($e^-$) emitted in the form of an electron beam from the emitter 11 are accelerated by a voltage difference between the anode 40 and the cathode 10 and then attracted toward the anode 40. Although not shown in this figure, when the electrons collide with a target material (not shown) disposed at the anode 40, an X-ray is emitted. The anode 40 may be an inclined anode or a transmissive anode. Since the insulating spacer 50 is positioned around the path along which the electrons accelerated with a high voltage are attracted toward the anode 40, electric charges are accumulated in the insulating spacer 50, and therefore, an abnormal operation may be caused. The electric charges accumulated in the insulating spacer 50 may be transferred to another electrode under a high-voltage atmosphere. In this case, the X-ray tube may be damaged due to flow of the electric charges in an arc form.

When the field emission electron source is used, the quantity of emitted electrons may be controlled using an active current control unit 60 configured by connecting a high-voltage field effect transistor, etc. in series to the cathode 10 as shown in FIG. 1. In this case, a reference voltage $V_{ref}$ of the active current control unit 60 may be a ground voltage (0V). Current limit conditions may be determined according to characteristics of a field emission emitter, gate voltages, and gate-source voltages applied to the field effect transistor. Here, the voltage of the cathode 10 may be increased as compared with the reference voltage $V_{ref}$. The voltage of the cathode 10 may be fluctuated depending on a change in characteristics of the emitter 11 by the active current control unit 60 that controls a field emission current to be constant under the current limit conditions. If a gate voltage $V_g$, a focusing voltage $V_f$, and an anode voltage $V_a$ are maintained constant, focusing characteristics of an electron beam may be changed as the voltage of the cathode 10 is changed under the current limit conditions.

SUMMARY

Embodiments provide a structure of an X-ray tube, which can stably driven under high-voltage conditions and constantly maintain focusing characteristics of an electron beam under current limit conditions.

According to an aspect of the present disclosure, there is provided an X-ray tube including: a cathode including an emitter emitting an electron beam; an anode at which a target material is disposed, the target material emitting an X-ray by colliding with the electron beam; and an insulating spacer isolating the anode, wherein the cathode or the anode is disposed between the emitter and the insulating spacer.

The X-ray tube may further include an outer cover surrounding the cathode and the anode, the outer cover blocking the cathode and the anode from external air. The insulating spacer may electrically isolate the anode and the outer cover from each other. The anode may be disposed between the emitter and the insulating spacer. The influence of the electron beam on the insulating spacer may be blocked by the anode.

The outer cover may include a conductor, and may be grounded.

The insulating spacer may electrically isolate the anode and the cathode from each other. The cathode may be disposed between the emitter and the insulating spacer. The influence on the electron beam on the insulating spacer may be blocked by the cathode.

At least one of the cathode and the anode may include a conductor.

The X-ray tube may further include a focusing electrode. The focusing electrode may be connected to the cathode, and the same level voltage may be supplied to the focusing electrode and the cathode.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
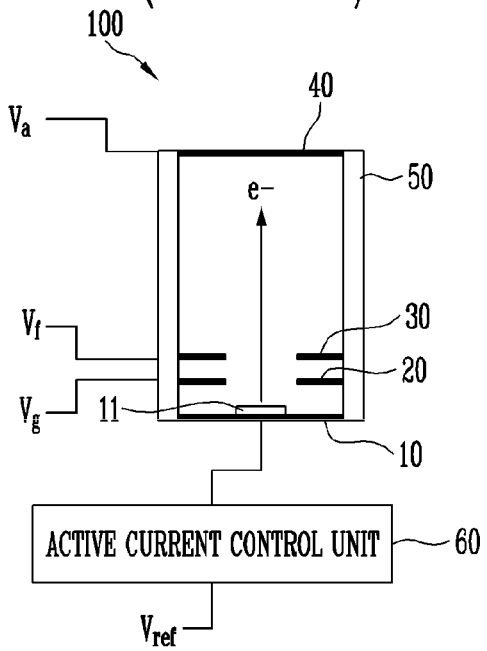
FIG. 1 (PRIOR ART)
FIG. 1 is a view illustrating a general structure of an X-ray tube requiring a high acceleration voltage.

Hereinafter, exemplary embodiments of the present disclosure will be described in detail with reference to the accompanying drawings. Like reference numerals indicate like elements throughout the specification and drawings. In the following description, detailed explanation of known related functions and constitutions may be omitted to avoid unnecessarily obscuring the subject manner of the present disclosure. Names of elements used in the following description are selected in consideration of facility of specification preparation. Thus, the names of the elements may be different from names of elements used in a real product.

In the entire specification, when an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

Figure 2:
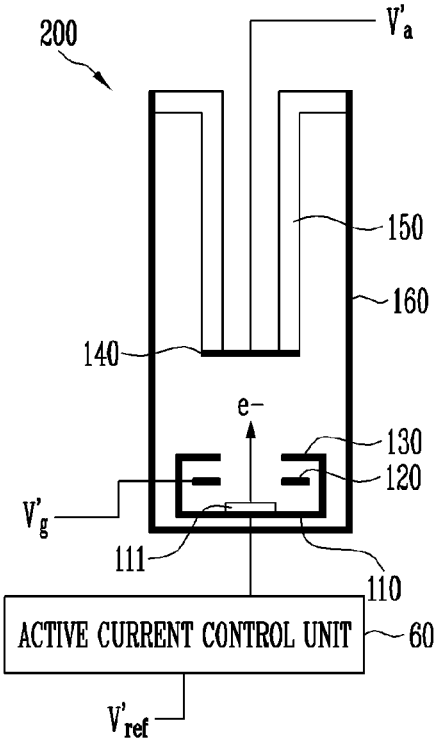
FIG. 2 is a view illustrating a structure of an X-ray tube according to an embodiment of the present disclosure.

FIG. 2 is a view illustrating a structure of an X-ray tube according to an embodiment of the present disclosure. The X-ray tube 200 according to the embodiment of the present disclosure includes a cathode 110, a gate 120, a focusing electrode 130, an anode 140, an insulating spacer 150, an active current control unit 60, and an outer cover 160.

Basic functions of the cathode 110, the gate 120, the focusing electrode 130, and the anode 140 are identical to those of the cathode 10, the gate 20, the focusing electrode 30, and the anode 40, respectively, and therefore, their detailed descriptions may be omitted. A high-level positive voltage may be supplied to the anode 140.

The focusing electrode 130 includes a conductor and is connected to the cathode 110 such that the same level voltage can be supplied thereto. Unlike FIG. 1, the focusing electrode 130 is not provided with a power source for independent potential control. As shown in FIG. 2, the focusing electrode 130 is the same electrode as the cathode 110. In this case, when the active current control unit 60 operates in a current limit mode, the voltage of the cathode 110 my be changeable such that the same field emission current is extracted depending on a change in characteristics of an emitter 111. In this state, the potential of the focusing electrode 130 is also changed together with that of the cathode 110. That is, when a small field emission current is extracted as the characteristics of the emitter 111 are deteriorated, the voltage level of the cathode 110 is decreased to a reference voltage $V'_{ref}$, and therefore, the difference between the voltage level of the cathode 110 with a voltage level $V'_g$ of the gate 120 is increased. At this time, an emitted electron beam may be further diffused due to the increased voltage difference between the gate 120 and the cathode 110. In this case, since the voltage level of the focusing electrode 130 is also decreased along the voltage level of the cathode 110, the focusing electrode 130 has the same focusing characteristics by focusing a larger quantity of electron beams. However, structural forms of the focusing electrode 130, i.e., a distance between gate electrodes, an opening size of the focusing electrode 130, and the like are to be determined by considering the gate voltage $V'_g$ supplied to the gate 120 when the potential of the cathode 110 is the reference voltage $V'_{ref}$, an anode voltage $V'_a$ supplied to the anode 140, and the like.

While the insulating spacer 50 shown in FIG. 1 electrically isolates between the cathode 10 and the anode 40, the insulating spacer 150 shown in FIG. 2 electrically isolates between the outer cover 160 and the anode 140.

The outer cover 160 includes a conductive layer, and may be grounded (0V) to a ground electrode (not shown). In this case, an electron beam has no influence on the outer cover 160 that includes the conductive layer and is grounded.

In FIG. 1, since no conductor exists between electrons ($e^-$) emitted in the form of an electron beam from the emitter 11 in the cathode 10 and the insulating spacer 50, the electrons ($e^-$) may have influence on the insulating spacer 50. On the other hand, in FIG. 2, the anode 140 is disposed between the emitter 111 and the insulating spacer 150. Also, the anode 140 exists between electrons ($e^-$) emitted in the form of an electron beam from the emitter 111 in the cathode 110 and the insulating spacer 150, and the outer cover 160 including the conductive layer is grounded. When the anode 140 includes a conductor, the influence of the electrons ($e^-$) on the insulating spacer 150 is blocked by the anode 140 disposed between the electrons ($e^-$) and the insulating spacer 150. In addition, the electron beam has no influence on the outer cover 160 that includes the conductive layer and is grounded. Thus, it is possible to prevent the accumulation of electric charges and the generation of arcs.

Figure 3:
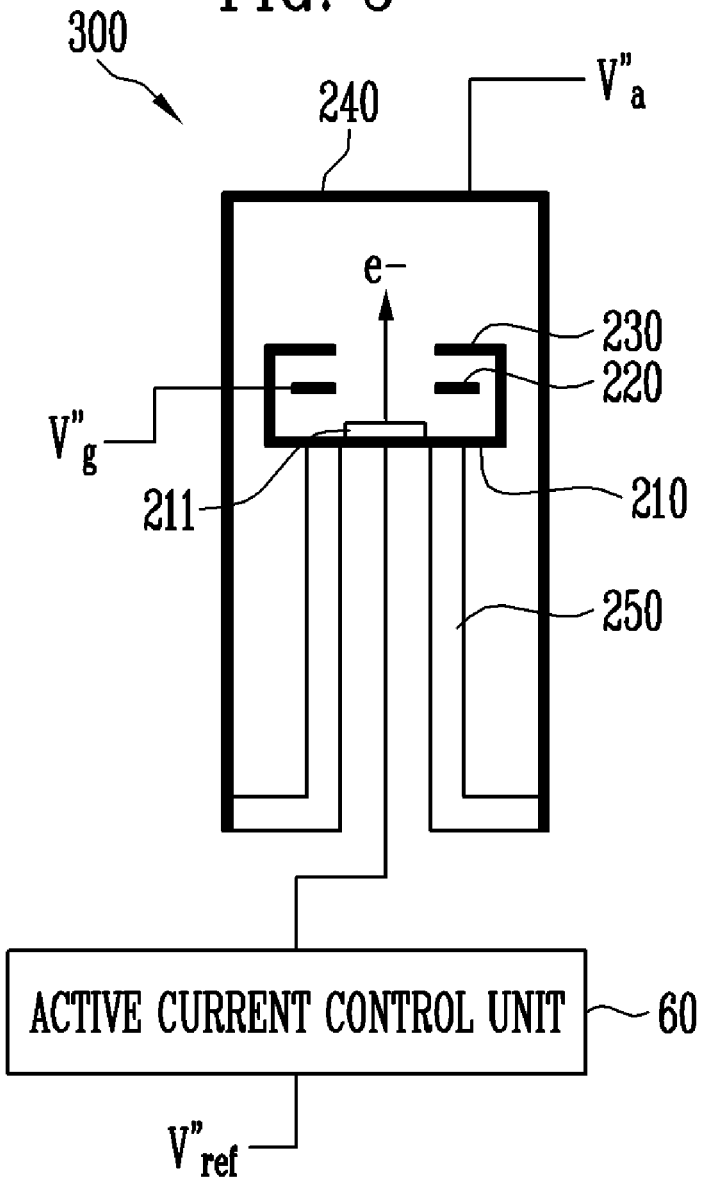
FIG. 3 is a view illustrating a structure of an X-ray tube according to another embodiment of the present disclosure.

FIG. 3 is a view illustrating a structure of an X-ray tube according to another embodiment of the present disclosure. The X-ray tube 300 according to the embodiment of the present disclosure includes a cathode 210, a gate 220, a focusing electrode 230, an anode 240, an insulating spacer 250, and an active current control unit 60.

Basic functions of the cathode 210, the gate 220, the focusing electrode 230, the anode 240, and the insulating spacer 250 are identical to those of the cathode 10, the gate 20, the focusing electrode 30, the anode 40, and the insulating spacer 50, respectively, and therefore, their detailed descriptions may be omitted.

A basic operation of the X-ray tube 300 shown in FIG. 3 is similar to that of the X-ray tube 200 shown in FIG. 2. However, the X-ray tube 300 may be a negative acceleration drive X-ray tube in which the anode 240 is grounded (0V), and a high-level negative voltage is supplied to the cathode 210.

In FIG. 1, since no conductor exists between electrons ($e^-$) emitted in the form of an electron beam from the emitter 11 in the cathode 10 and the insulating spacer 50, the electrons ($e^-$) may have influence on the insulating spacer 50. On the other hand, in FIG. 3, the cathode 210 is disposed between an emitter 211 and the insulating spacer 250. Also, the cathode 210 exists between electrons ($e^-$) emitted in the form of an electron beam from the emitter 211 in the cathode 210 and the insulating spacer 250, and the anode 240 is grounded. When the cathode 210 includes a conductor, the influence of the electrons ($e^-$) on the insulating spacer 250 is blocked by the cathode 210 disposed between the electrons ($e^-$) and the insulating spacer 250. In addition, the insulating spacer 250 is disposed in a direction opposite to that in which the electrons ($e^-$) advance based on the emitter 211, and an electron beam has no influence on the anode 240 that includes a conductive layer and is grounded. Thus, it is possible to prevent the accumulation of electric charges and the generation of arcs.

According to the present disclosure, it is possible to provide a structure of an X-ray tube, which is stable under high-voltage conditions. Also, it is possible to provide a structure of an X-ray tube, in which focusing characteristics of an electron beam are not changed when current is controlled.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims.

What is claimed is:

1. An X-ray tube comprising:

a cathode including an emitter emitting an electron beam;

an anode at which a target material is disposed, the target material emitting an X-ray by colliding with the electron beam; and an insulating spacer isolating the anode, wherein the cathode or the anode is disposed between the emitter and the insulating spacer.

2. The X-ray tube of claim 1, further comprising an outer cover surrounding the cathode and the anode, the outer cover blocking the cathode and the anode from external air, wherein the insulating spacer electrically isolates the anode and the outer cover from each other, the anode is disposed between the emitter and the insulating spacer, and the influence of the electron beam on the insulating spacer is blocked by the anode.

3. The X-ray tube of claim 2, wherein the outer cover includes a conductor and is grounded.

4. The X-ray tube of claim 1, wherein the insulating spacer electrically isolates the anode and the cathode from each other, the cathode is disposed between the emitter and the insulating spacer, and the influence on the electron beam on the insulating spacer is blocked by the cathode.

5. The X-ray tube of claim 1, wherein at least one of the cathode and the anode includes a conductor.

6. The X-ray tube of claim 1, further comprising a focusing electrode, wherein the focusing electrode is connected to the cathode, and a same level voltage is supplied to the focusing electrode and the cathode.

* * * * *